US007904014B2

(12) United States Patent
Umehara et al.

(10) Patent No.: US 7,904,014 B2
(45) Date of Patent: Mar. 8, 2011

(54) WASTE TONER COLLECTING DEVICE AND IMAGE FORMING APPARATUS PROVIDED WITH THE SAME

(75) Inventors: Takao Umehara, Ikoma (JP); Takashi Kubo, Kizugawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 302 days.

(21) Appl. No.: 12/165,895

(22) Filed: Jul. 1, 2008

(65) Prior Publication Data

US 2009/0016793 A1 Jan. 15, 2009

(30) Foreign Application Priority Data

Jul. 13, 2007 (JP) ..... 2007-184506

(51) Int. Cl.
*G03G 21/00* (2006.01)

(52) U.S. Cl. ..... 399/358; 399/360

(58) Field of Classification Search ..... 399/343, 399/358, 360; 366/320, 331
See application file for complete search history.

(56) References Cited

U.S. PATENT DOCUMENTS 5,113,227 A * 5/1992 Miyasaka ..... 399/358
5,130,756 A * 7/1992 Taniyama ..... 399/358
5,289,955 A * 3/1994 Sulenski
5,524,796 A * 6/1996 Hyer
7,233,766 B2 * 6/2007 Matsuyama et al. ..... 399/358
7,311,438 B2 * 12/2007 Kim et al. ..... 366/320
7,463,859 B2 * 12/2008 Ito et al. ..... 399/358
2006/0072947 A1 * 4/2006 Marin et al. ..... 399/358

FOREIGN PATENT DOCUMENTS

JP 4-134381 5/1992
JP 5-35158 A 2/1993
JP 9-212056 A 8/1997
JP 9-218627 A 8/1997
JP 10-104957 A 4/1998
JP 11-84969 A 3/1999
JP 11-084971 3/1999
JP 2000172076 A * 6/2000
JP 2002-82505 A 3/2002
JP 2005-250395 A 9/2005

* cited by examiner

*Primary Examiner* — Susan S Lee
(74) *Attorney, Agent, or Firm* — Nixon & Vanderhye, PC

(57) ABSTRACT

A waste toner collecting device comprising: a waste toner removing section that removes a toner which is adhered on a surface of a member to be cleaned, as waste toner; a waste toner storing section that stores the waste toner; and a waste toner transporting section that transports the waste toner to the waste toner storing section, wherein the waste toner transporting section includes a waste toner transporting path, a rotatable shaft arranged in the waste toner transporting path, a transport screw that is arranged at an outer periphery of the shaft in the waste toner transporting path and that has one end in a longitudinal direction coupled to the shaft, and a driving section that is coupled to the other end of the transport screw in the longitudinal direction so as to transmit a rotational force or that is coupled to the shaft so as to transmit a rotational force while rotatably supporting the other end of the transport screw.

20 Claims, 4 Drawing Sheets

WASTE TONER COLLECTING DEVICE AND IMAGE FORMING APPARATUS PROVIDED WITH THE SAME

CROSS-REFERENCE TO RELATED APPLICATION

This application is related to Japanese patent application No. 2007-184506, filed on Jul. 13, 2007 whose priority is claimed under 35 USC §119, the disclosure of which is incorporated by reference in its entirety.

BACKGROUND OF THE TECHNOLOGY

1. Field of the Technology

The technology relates to a waste toner collecting device that transports a waste toner to a collection container without blocking the waste toner, and an image forming apparatus provided with the same.

2. Description of the Related Art

Conventionally, in an image forming apparatus employing an electrophotographic system, such as a copier, printer, or the like, a photoconductor drum which is rotatably driven is charged by a charging device, an electrostatic latent image is formed on the photoconductor drum by a light irradiation according to image information, and toner particles are adhered onto the electrostatic latent image by using a developing device to form a toner image. The toner image which is made visible is then transferred onto a recording sheet by a transfer section, which is arranged along the outer periphery of the photoconductor drum, by means of a transfer electric field.

During the transfer process, all of the toner particles on the photoconductor drum are not transferred onto the recording sheet. The transfer efficiency is about 85 to 95%, although it is different depending upon a device or a transfer section. Specifically, a little amount of toner and paper powders remain on the photoconductor drum after the toner image is transferred onto the recording sheet. If a surface of the photoconductor drum having adhered thereon the remaining toner and paper powders is not cleaned, it results in a main cause for deteriorating the quality of printing when the toner image is transferred onto a next recording sheet.

Therefore, a conventional image forming apparatus is provided with a waste toner collecting device for collecting toner remaining on the photoconductor drum after the transfer of the toner image. The waste toner collecting device is mounted at a downstream side of the transfer section at the outer periphery of the photoconductor drum.

The conventional waste toner collecting device includes a cleaning section that removes the residual toner from the surface of the photoconductor drum with paper powders, and a waste toner transporting section that transports the removed toner to a collection container.

In general, the waste toner transporting section is configured to include a screw shaft in a cylindrical transporting path that connects the cleaning section and the collection container, wherein the screw shaft is rotated by a drive motor so as to transport the waste toner accumulated in the transporting path to the collection container.

The fluidity of the waste toner reduces more than that of non-used toner. Therefore, the waste toner in the waste toner transporting section adheres onto an inner face of the transporting path and the screw shaft, and the adhered toner is aggregated and grown as the image forming apparatus is used. Since a gap between the screw shaft and an inner wall face of the transporting path is small in the waste toner transporting section, the toner aggregation causes an increase in a driving load of the screw shaft.

When the driving load of the screw shaft increases to cause a non-uniform rotation, furthermore when the toner aggregation is solidified to form an agglomerate in the transporting path and the agglomerate blocks the transporting path, which hinders the rotation of the screw shaft, a blocking phenomenon occurs in which the waste toner is extraordinarily accumulated in the waste toner transporting section to thereby hinder a transporting function. Therefore, there arises a problem that the waste toner cannot be discharged, and hence, the residual toner on the surface of the photoconductor drum after the transfer cannot be cleaned. Accordingly, in the very worst case, the cleaning section is filled with the waste toner, which causes a poor cleaning of the photoconductor drum, a generation of a scratch on the surface of the photoconductor drum, and a breakdown of the waste toner collecting device.

As a countermeasure for these problems, there has been proposed an apparatus in which, for example, a screw of a screw shaft is formed from a coil-like spring member. In the apparatus, the spring member is rotated for grinding the toner aggregation by a rotational force or vibration of the spring member, in order to avoid the blocking phenomenon by facilitating the transportation of the waste toner (see, for example, Japanese Unexamined Patent Publication No. 11-84971).

However, in a method for transporting the waste toner by the coil-like spring member described above, a sufficient transporting force for transporting the waste toner and sufficient transporting amount cannot be obtained, so that the transporting efficiency is not satisfactory.

SUMMARY OF THE TECHNOLOGY

The present technology is accomplished in view of the aforesaid conventional problems, and aims to provide a waste toner collecting device that efficiently transports waste toner to a collection container without causing a blocking phenomenon, and an image forming apparatus provided with the same.

The technology provides a waste toner collecting device comprising a waste toner removing section that removes a toner which is adhered on a surface of a member to be cleaned, as waste toner; a waste toner storing section that stores the waste toner; and a waste toner transporting section that transports the waste toner to the waste toner storing section, wherein the waste toner transporting section includes a waste toner transporting path, a rotatable shaft arranged in the waste toner transporting path, a transport screw that is arranged at an outer periphery of the shaft in the waste toner transporting path and that has one end in a longitudinal direction coupled to the shaft, and a driving section that is coupled to the other end of the transport screw in the longitudinal direction so as to transmit a rotational force or that is coupled to the shaft so as to transmit a rotational force while rotatably supporting the other end of the transport screw.

According to another aspect, the technology provides an image forming apparatus comprising a photoconductor that is formed a toner image on its surface by toner, a sheet feeding section that feeds a recording sheet to the photoconductor, a transfer section having a transfer belt that transfers the toner image onto the surface of the photoconductor to the recording sheet, a fixing section having a fuser roller that fixes the toner image transferred onto the recording sheet, and the waste toner collecting device, wherein the waste toner collecting device is at least any one of a first waste toner collecting device that collects remaining untransferred toner left on the surface of the photoconductor after the transfer as waste toner, a second waste toner collecting device that collects toner adhered on the transfer belt after the transfer as waste toner, and a third waste toner collecting device that collects toner adhered onto the fuser roller after the fixation as waste toner.

In the waste toner collecting device, one end of the transport screw in the longitudinal direction is coupled to the shaft, and the other end of the transport screw is not coupled to the shaft, whereby a portion of the transport screw not coupled to the shaft is movable in a diameter direction. Therefore, a gap is formed between the transport screw and the shaft when the device is stopped.

With this configuration, when the driving section rotates the transport screw, the transport screw moves in a direction of biting the shaft (in a diameter-reducing direction) as rotating. When the driving section rotates the shaft, the transport screw moves in the direction of biting the shaft (in the diameter-reducing direction) as rotating. Specifically, the transport screw and the shaft are rotated with the timing of the rotation shifted.

According to the rotational operation of the transport screw and the shaft as described above, the waste toner that is about to adhere to an edge of the transport screw at the center is scraped off, whereby the blocking phenomenon in which the waste toner is extraordinarily accumulated to hinder the transporting function of the transport screw can be prevented.

Further, in the waste toner collecting device, the shaft or the transport screw is in its free state when the rotation of the transport screw or the shaft is stopped. Therefore, the transport screw moves in a returning direction, i.e., in a direction apart from the shaft, whereby the gap is formed again between the transport screw and the shaft.

BRIEF DESCRIPTION OF THE DRAWINGS

FIGS. 1A and 1B are diagrams showing a schematic configuration of a waste toner collecting device according to embodiment 1, wherein FIG. 1A shows a state in which the device is stopped, and FIG. 1B shows a state in which the device is driven to transport waste toner;

DETAILED DESCRIPTION OF THE PREFERRED EMBODIMENTS

Figure 1A:
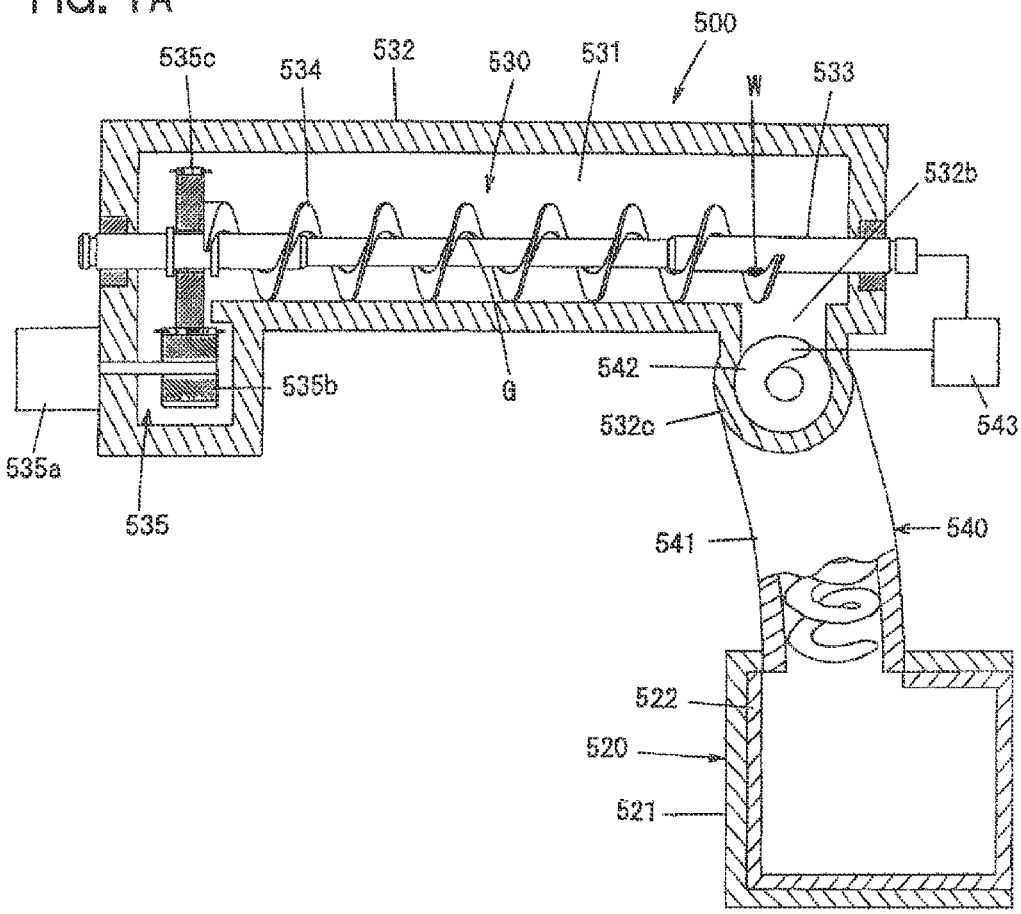

A waste toner collecting device includes a waste toner removing section that removes a toner which is adhered on a surface of a member to be cleaned, as a waste toner, a waste toner storing section that stores the waste toner, and a waste toner transporting section that transports the waste toner to the waste toner storing section, wherein the waste toner transporting section includes a waste toner transporting path, a rotatable shaft arranged in the waste toner transporting path, a transport screw that is arranged at an outer periphery of the shaft in the waste toner transporting path and that has one end in a longitudinal direction coupled to the shaft, and a driving section that is coupled to the other end of the transport screw in the longitudinal direction so as to transmit a rotational force or that is coupled to the shaft so as to transmit a rotational force while rotatably supporting the other end of the transport screw.

The technology is applicable to an image forming apparatus of an electrophotographic system such as a copier, printer, facsimile, complex machine having multifunction as described above, etc.

The driving section of the waste toner transporting section may have a configuration (A) for transmitting the rotational force to the transport screw or a configuration (B) for transmitting the rotational force to the shaft as described above.

Examples of the configuration (A) include the one in which both ends of the shaft are rotatably and pivotally attached to a wall portion of a casing that constitutes the waste toner transporting path, a drive gear is rotatably mounted to the shaft at an upstream side in the waste toner transporting direction, an end portion of the transport screw at the upstream side in the transporting direction is coupled to one surface of the drive gear, and the drive gear is rotated by a motor.

Examples of the configuration (B) include the one in which both ends of the shaft are rotatably attached to the wall portion of the casing that constitutes the waste toner transporting path, a rotating disc is rotatably mounted to the shaft at the upstream side in the waste toner transporting direction, the end portion of the transport screw at the upstream side in the transporting direction is coupled to one surface of the rotating disc, and the shaft is rotated by a motor.

When the driving section is configured to have the configuration (A) and (B), a servo motor that can normally and inversely rotate is preferably used as a motor. The transport screw can be normally rotated or can be inversely rotated at a predetermined timing by using the servo motor.

The waste toner in the waste toner transporting path can be conveyed to the waste toner storing section at a downstream side in the transporting direction by normally rotating the transport screw. In this case, the transport screw moves in a diameter-reducing direction (in a direction of tightening the shaft) with respect to the shaft as described above, whereby the gap between the transport screw and the shaft is reduced. It is to be noted that the transport screw also moves in an axial direction in which the screw pitch is slightly reduced.

According to the operation of the transport screw, the waste toner that is likely to adhere onto an edge of the transport screw at the central side that is a corner section between the transport screw and the shaft is scraped off. Specifically, the waste toner easily adhere onto this portion. Therefore, the blocking phenomenon occurs in which the waste toner is extraordinarily accumulated in the waste toner transporting path can be prevented.

On the other hand, when the rotating transport screw is stopped, the transport screw moves in a direction of returning to the original free state, i.e., in a diameter-increasing direction (in a direction of loosening the shaft), so that the gap is again formed between the transport screw and the shaft. It is to be noted that the transport screw also moves in an axial direction of slightly increasing the screw pitch.

With this operation, the corner portion between the transport screw and the shaft is eliminated. Therefore, the portion where the waste toner adheres, which is the prestage of the extraordinary accumulation of the waste toner, is difficult to be formed. Further, even if the waste toner adheres onto the edge of the transport screw at the central side, the waste toner can be scraped off during the normal rotation as described above.

Since the transport screw is inversely rotated several times (once or twice), the waste toner in the waste toner transporting path is transported to the upstream side in the transporting direction, whereby the waste toner is loosened, and the waste toner adhering to an inner wall face of the waste toner transporting path can be scraped off. Consequently, the blocking phenomenon in which the waste toner is extraordinarily accumulated in the waste toner transporting path can more effectively be prevented.

The transport screw is preferably made of a coil spring. By the structure of the transport screw made of a coil spring, the transport screw can greatly and easily be moved in the diameter direction and axial direction due to the elasticity, whereby the waste toner that is about to adhere onto the edge of the transport screw at the central side can effectively be scraped off. The material of the coil spring is not limited to a metal, but a hard rubber.

The waste toner removing section may be configured to include a casing having a lower part communicating with the upstream side of the waste toner transporting path in the transporting direction and an upper opening part that is open, and a cleaning blade that is attached at the upper opening portion of the casing so as to be capable of being in contact with the surface of the member to be cleaned. With this configuration, the waste toner is removed from the surface of the member to be cleaned by the cleaning blade, and the waste toner is dropped into the waste toner transporting path to be collected, by relatively moving the cleaning blade and the member to be cleaned.

The waste toner storing section may be configured to include an outer box having an upper connection port that communicates with the downstream side of the waste toner transporting path in the transporting direction, and a waste toner collecting box that is detachably mounted in the outer box and has an upper opening part, wherein the waste toner transported to the outer box is received by the waste toner collecting box.

When the waste toner storing section is arranged immediately below the downstream side of the waste toner transporting path in the transporting direction, an opening portion that is open downward may be formed to the downstream end portion of the waste toner transporting path, wherein the transported waste toner may be dropped into the waste toner storing section from the opening portion. When the waste toner storing section is arranged at the position apart from the downstream side of the waste toner transporting path in the transporting direction, a relay transporting path (e.g., a flexible tube) that couples and communicates the downstream end portion of the waste toner transporting path with the waste toner storing section is provided, and a coil spring may be provided in the relay transporting path, wherein the coil spring is rotated by a motor so as to transport the waste toner from the waste toner transporting path to the waste toner storing section via the relay transporting path.

The member to be cleaned, which is the subject of the waste toner collecting device, is the one in which the waste toner that should be removed is adhered on its surface. Specific examples of the member to be cleaned include a photoconductor, a transfer belt, a fuser roller, etc. provided in an image forming apparatus of an electrophotographic system, such as a copier, printer, facsimile, etc.

The technology provides an image forming apparatus comprising a photoconductor that is formed a toner image on its surface by toner, a sheet feeding section that feeds a recording sheet to the photoconductor, a transfer section that transfers the toner image onto the surface of the photoconductor to the recording sheet, a fixing section that fixes the toner image transferred onto the recording sheet, and the waste toner collecting device described above, wherein the waste toner collecting device is at least any one of a first waste toner collecting device that collects remaining untransferred toner left on the surface of the photoconductor after the transfer as waste toner, a second waste toner collecting device that collects toner adhered on the transfer section after the transfer as waste toner, and a third waste toner collecting device that collects toner adhered onto the fixing section after the fixation as waste toner.

The embodiments of the technology will be described in detail below with reference to the drawings.

Embodiment 1 of a Waste Toner Collecting Device

Figure 1B:
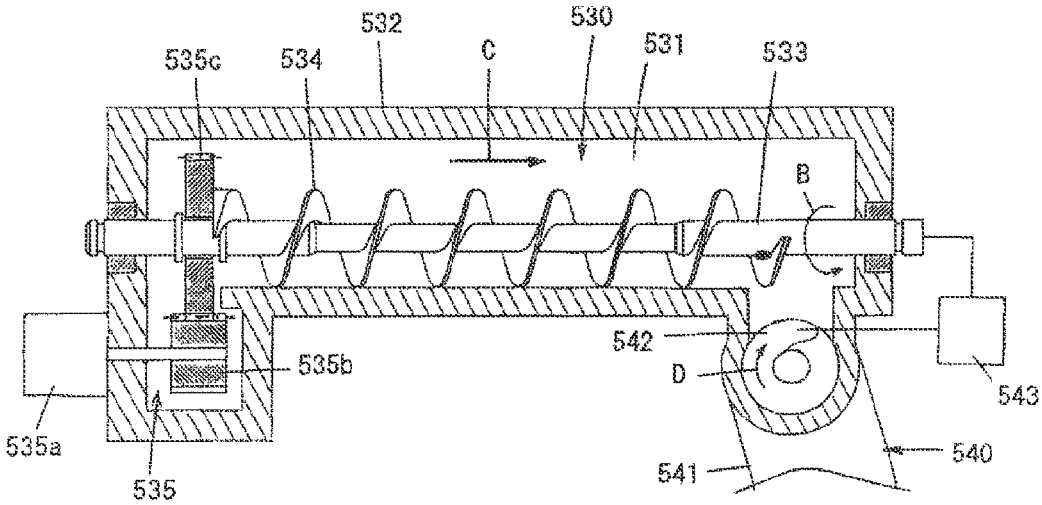
Figure 2:
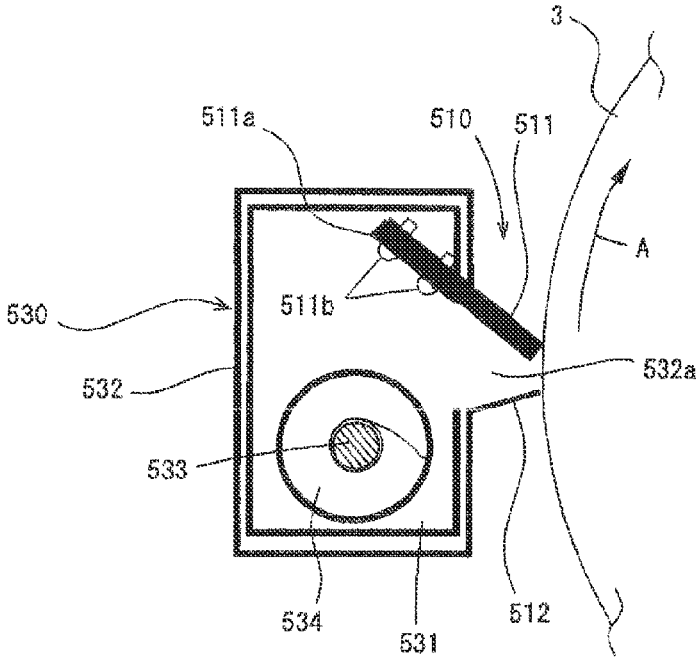
FIG. 2 is a schematic sectional view of a waste toner transporting section, viewed from an upstream side, of the waste toner collecting device according to embodiment 1.

FIGS. 1A and 1B are diagrams schematically showing a configuration of a waste toner collecting device 1 according to embodiment 1, wherein FIG. 1A shows a state in which the device is stopped, and FIG. 1B shows a state in which the device is driven to transport waste toner. FIG. 2 is a schematic sectional view of a waste toner transporting section in the waste toner collecting device according to the embodiment 1 viewed from an upstream side. In FIG. 2, numeral 3 denotes a photoconductor drum of an image forming apparatus as one example of a member to be cleaned, and sign A denotes a direction of the rotation of the photoconductor drum.

As shown in FIGS. 1 and 2, a waste toner collecting device 500 includes a waste toner removing section 510 that removes toner to be removed (not shown), which are adhered onto the surface of the member to be cleaned (in this case, a photoconductor drum 3), from the surface as a waste toner, a waste toner storing section 520 that stores the waste toner, and a waste toner transporting section 530 that transports the waste toner, which is removed from the surface of the member to be cleaned, to the waste toner storing section 520.

The waste toner transporting section 530 includes a casing 532 constituting a waste toner transporting path 531, a rotatable shaft 533 arranged in the waste toner transporting path 531 (casing 532), a transport screw 534 arranged at an outer periphery of the shaft 533 in the waste toner transporting path 531, and a driving section 535 that is coupled to the transport screw 534 so as to transmit a rotational force.

The casing 532 is arranged along the photoconductor drum 3. The casing 532 is formed into a generally rectangular solid longer than the length of the photoconductor drum 3, and its inside is defined as the waste toner transporting path 531. An opening portion 532*a* having the length substantially equal to the length of the photoconductor drum 3 is formed at a wall portion of the casing 532 opposite to the photoconductor drum 3.

Both ends of the shaft 533 are pivotally attached to both side walls of the casing 532 positioned in the longitudinal direction.

The driving section 535 includes a servo motor 535*a* mounted to a side wall of the casing 532 at the upstream side with respect to the transporting direction, a first drive gear 535*b* that is fixed to a drive shaft of the servo motor 535*a* penetrating through the side wall of the casing 532, and a second drive gear 535*c* that is rotatably mounted to the shaft 533 at the downstream side with respect to the transporting direction and is meshed with the first drive gear 535*b*. The movement of the first drive gear 535*b* in an axial direction with respect to the shaft 533 is restricted. The casing 532 has a structure in which the waste toner transporting path 531 housing the transport screw 534 and a gear housing that houses the first and second drive gears 535*b* and 535*c* communicate with each other, wherein the gear housing is shielded from the outside so as to prevent the leakage of the waste toner to the outside.

The transport screw 534 is made of a coil spring. One end of the transport screw 534 at the downstream side in the transporting direction is fixed to the shaft 533, while the other end at the upstream side in the transporting direction is fixed to one surface of the second drive gear 535*c* of the driving section 535, and is arranged in the vicinity of the bottom surface of the casing 532. In FIG. 1, sign W denotes a fixing portion where the transport screw 534 and the shaft 533 are fixed by welding.

In the present embodiment, the waste toner transporting section 530 further includes a relay transporting section 540 for transporting the waste toner in the waste toner transporting path 531 in the casing 532 to the waste toner storing section 520 in order that the later-described waste toner storing section 520 is arranged separate from the casing 532.

The relay transporting section 540 includes a relay transporting path 541 that is made of a flexible tube and that contiguously connects a waste toner discharge port 532*b* formed at the bottom face of the end portion of the casing 532 at the downstream side in the transporting direction and the waste toner storing section 520, a coil spring 542 provided in the relay transporting path 541 so as to be rotatable, and a driving section 543 that rotatably drives the coil spring 542.

More specifically explained, a connection cylindrical portion 532*c* that communicates with the waste toner discharge port 532*b* is provided at the end portion of the casing 532 at the downstream side in the transporting direction. The connection cylindrical portion 532*c* is a short cylinder extending in the direction orthogonal to the longitudinal direction of the casing 532. One end of the connection cylindrical portion 532*c* is open and is connected to the relay transporting path 541, while the other end thereof is blocked off from the outside by the end wall. The waste toner discharge port 532*b* communicates with the upper part of the connection cylindrical portion 532*c*. The end portion of the coil spring 542 at the downstream side in the transporting direction is arranged in the connection cylindrical portion 532*c*.

The driving section 543 of the relay transporting section 540 can be configured, for example, to include a link shaft that penetrates the end wall of the connection cylindrical portion 532*c* so as to be pivotally attached, a rotating disc, not shown, fixed to the end portion of the link shaft at the inner side of the connection cylindrical portion 532*c*, and a transmission gear, not shown, for transmitting a rotational force of the shaft 533 to the link shaft, wherein the end portion of the coil spring 542 at the upstream side in the transporting direction is coupled to the rotating disc.

The waste toner removing section 510 includes a cleaning blade 511 provided along an upper edge of the opening portion 532*a* of the casing 532, and a waste toner leakage prevention blade 512 provided along a lower edge of the opening portion 532*a* of the casing 532.

The cleaning blade 511 is a long plate made of a rubber material having a predetermined hardness, and is formed along the axis of the photoconductor drum 3 with a length longer than the range where the toner image is formed. The cleaning blade 511 is nipped between a folded part formed so as to be folded from the upper edge of the opening portion 532*a* of the casing 532 toward the inside with a predetermined angle and a blade-mounting plate 511*a*. A mounting screw 511*b* is mounted from the side of the blade-mounting plate 511*a*, whereby the cleaning blade 511 is detachably mounted to the casing 532 so as to be in contact with the outer peripheral surface of the photoconductor drum 3 with a predetermined pressure.

The waste toner leakage prevention blade 512 is a long plate made of a plastic, and is formed at the opposite position below the cleaning blade 511 with a length the same as that of the cleaning blade.

In the waste toner removing section 510 thus configured, the residual toner and paper powders adhered onto the surface of the photoconductor drum 3 are flipped from the photoconductor drum 3 by utilizing a phenomenon (so-called "stick-slip phenomenon") in which the leading end of the cleaning blade 511 that is in contact with the outer peripheral surface of the photoconductor drum 3 with a predetermined pressure is flipped from the surface of the rotating photoconductor drum 3, and the waste toner leakage prevention blade 512 prevents the flipped residual toner or others from scattering to the outside of the casing 532.

The waste toner storing section 520 includes an outer box 521 having an upper connection port that is contiguously connected to the downstream side of the relay transporting path 541 in the transporting direction, and a waste toner collecting box 522 that is detachably mounted into the outer box 521 and has an open upper part.

Next, the operation of the waste toner collecting device according to the embodiment 1 will be explained with reference to FIGS. 1 and 2.

In the stopped state shown in FIG. 1A, since the transport screw 534 is made of a coil spring, and only its one end is coupled to the shaft 533, a gap G is formed between the transport screw 534 and the shaft 533 arranged in the transport screw 534. Since the other end of the transport screw 534 is not coupled to the shaft 533 but coupled to the second drive gear 535*c* of the driving section 535, the shaft 533 is in a free state relative to the transport screw 534 and the drive gear 535*c*.

When the waste toner collecting device is started to be driven as shown in FIG. 1B, the rotational force of the servo motor 535*a* is transmitted to the second drive gear 535*c* from the first drive gear 535*b*, whereby the transport screw 534 starts to rotate in the direction shown by an arrow B.

In this case, only one portion of the shaft 533 at the downstream side in the transporting direction is coupled to the transport screw 534, and the above-mentioned gap G is formed between the shaft 533 and the transport screw 534, so that the shaft 533 does not starts to rotate in parallel with the transport screw 534 starts to rotate.

Since the transport screw 534 is a coil spring, it moves inward in the diameter direction so as to tighten the shaft 533 and in the direction in which the screw pitch is reduced, as soon as the transport screw 534 starts to rotate, whereby the inner edge of the transport screw 534 is brought into contact with the shaft 533 in such a manner that the transport screw 534 bites the shaft 533. Accordingly, the gap G is eliminated, with the result that the rotational force of the transport screw 534 is transmitted to the shaft 533, and hence, the shaft 533 rotates with a time difference.

Because the transport screw 534 and the shaft 533 rotate as described above, the waste toner in the waste toner transporting path 531 is transported to the downstream side in the transporting direction (in the direction shown by an arrow C) by the rotation of the transport screw 534, as well as the waste toner adhering to or about to adhere to the vicinity of the inner edge of the transport screw 534 can be scraped off or loosened thanks to the friction caused between the transport screw 534 and the shaft 533. Accordingly, the waste toner can be transported without causing a blocking phenomenon, even if the device is used for a long time.

On the other hand, during the rotation of the transport screw 534, the coil spring 542 also rotates in the direction shown by an arrow D by the interlocking operation of the driving section 543 of the relay transporting section 540, whereby the waste toner transported toward the downstream side of the waste toner transporting path 531 in the transporting direction and falling into the connection cylindrical portion 532*c* is transported in the relay transporting path 541 by the rotating coil spring 542, and falls into the waste toner collecting box 522 of the waste toner storing section 520.

When a certain amount of waste toner is collected, when the waste toner collecting operation is performed for a predetermined time, or when a periodic maintenance is needed, the waste toner storing box 522 is taken out from the outer box 521 for discarding the waste toner (including residual toner and paper powders) collected in the waste toner storing box 522.

When the driving section 535 that is now driven is stopped, the transport screw 534 stops its rotation, but it moves in the outward direction in the diameter direction in which it is apart from the shaft 533 and in the direction of increasing the screw pitch, due to the restoring force of the coil spring. Thereafter, the rotation of the shaft 533 is stopped (see FIG. 1A). In this case, the relay transporting section 540 is also stopped.

Since the transport screw 534 and the shaft 533 operate as described above when they stop, the waste toner, which adheres or is about to adhere to the wall face of the waste toner transporting section 531 receives the force reverse to the transporting direction (the direction shown by an arrow C) to thereby be loosened.

The transport screw 534 may be inversely rotated several times by the servo motor 535*a* immediately after the driving section 535 stops. The transport screw 534 is inversely rotated as described above, whereby the transport screw 534 moves in the outward direction in the diameter direction in which it is apart from the shaft 533 and in the direction of increasing the screw pitch, as inversely rotating. Therefore, the waste toner in the waste toner transporting path is transported toward the upstream side in the transporting direction to be loosened, and the waste toner adhering onto the inner wall face of the waste toner transporting path can be scraped off. As a result, the blocking phenomenon in which the waste toner is extraordinarily accumulated in the waste toner transporting path can effectively prevented.

Embodiment 2 of Waste Toner Collecting Device

Figure 3:
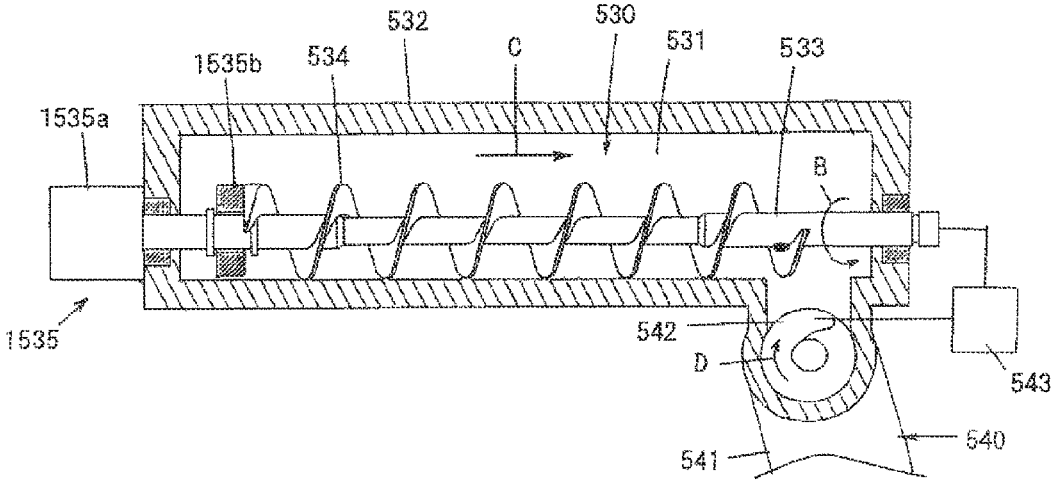
FIG. 3 is a sectional view showing a waste toner transporting section in a waste toner collecting device according to embodiment 2.

The waste toner collecting device according to the embodiment 1 is configured such that the driving section 535 of the waste toner transporting section 530 directly drives the transport screw 534 to rotate as described above. However, as shown in FIG. 3, the device may be configured such that the shaft 533 is directly rotated. Specifically, a driving section 1535 in the embodiment 2 includes a servo motor 1535*a* coupled to the shaft 533, and a disc 1535*b* mounted at the upstream side in the transporting direction of the shaft 533 so as to be rotatable, wherein the movement of the disc 1535*b* in the direction of the axis of the shaft 533 is restricted, and the disc 1535*b* is coupled to the end portion of the transport screw 534 at the upstream side in the transporting direction. In FIG. 3, the components the same as those in the embodiment 1 are identified by the same numerals.

Even with this structure, the transport screw 534 rotates with a time difference by the normal rotation of the shaft 533 in the direction shown by an arrow B, like the embodiment 1. In this case, the transport screw 534 moves in the direction of reducing the diameter in which the shaft 533 is tightened, so that the waste toner adhered on the inner edge of the transport screw 534 is scraped off. When the shaft 533 that is now driven is stopped or inversely rotated, the transport screw 534 operates in the same manner as in the embodiment 1, whereby the waste toner is loosened.

Another Embodiment of Waste Toner Collecting Device

In the above-mentioned embodiment, the device for collecting the residual toner onto the photoconductor drum 3 is taken as an example of the waste toner collecting device 500. However, the portion from which the residual toner or paper powders produced during a printing process are collected is not limited to the photoconductor drum 3, and the technology is applicable to a waste toner collecting device for collecting residual toner produced during the other printing process such as a transfer process, fixing process, or the like.

The waste toner transporting section, which is a main component of the waste toner collecting device, is applicable to a developing device 2 of a later-described image forming apparatus and a toner supplying mechanism (see FIGS. 4 and 5) supplying toner to this developing device 2. Specifically, a toner transporting mechanism provided in the developing device 2 and the toner supplying mechanism can be composed of the waste toner transporting section.

Although the aforesaid embodiment illustrates the waste toner collecting device 500 provided with the relay transporting section 540, the relay transporting section 540 is omitted, and the upper opening portion of the outer box 521 of the waste toner storing section 520 may directly be connected to the waste toner discharge port 532*b* of the casing 532.

(Explanation of Image Forming Apparatus)

Figure 4:
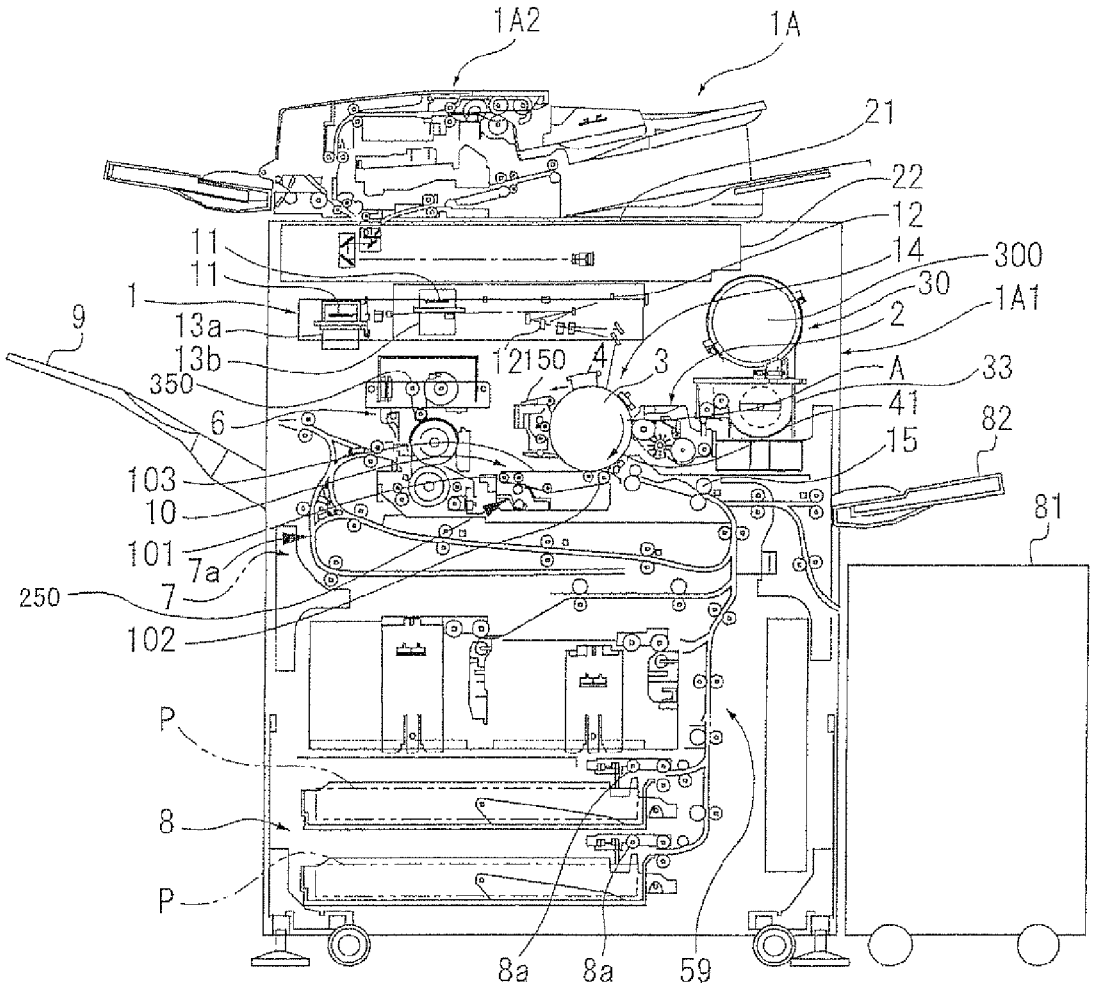
FIG. 4 is an explanatory view showing the overall configuration of an image forming apparatus provided with the waste toner collecting device.
Figure 5:
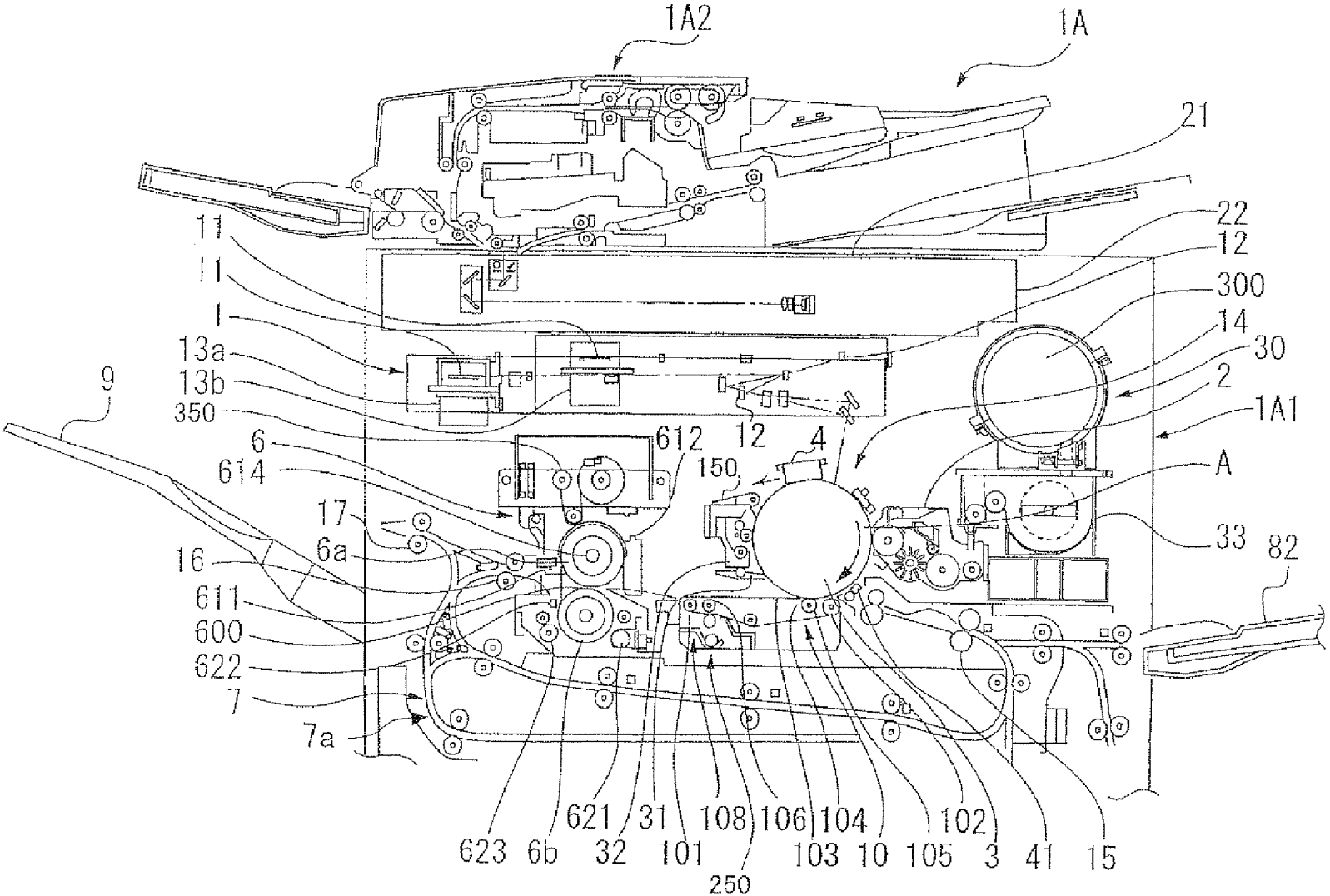
FIG. 5 is a view showing the detail of the partial configuration of a main body of the image forming apparatus shown in FIG. 4.

FIG. 4 is an explanatory view showing the overall configuration of an image forming apparatus provided with the waste toner collecting device thus configured, and FIG. 5 is a view partially showing the detail of the configuration of the main body of the image forming apparatus shown in FIG. 4.

An image forming apparatus 1A forms an electrostatic latent image onto the cylindrical photoconductor drum 3, which is rotatably driven, from image data read in a scanner or image data externally transmitted, with an electrophotographic system, develops the electrostatic latent image to a toner image by a developer, which is obtained by mixing two components, i.e., charged toner and magnetic carriers, and then, transfers the toner image onto a recording sheet (hereinafter simply referred to as sheet) and outputs the same as a monochrome image.

As shown in FIGS. 4 and 5, the image forming apparatus 1A is mainly composed of a main body 1A1, an automatic document feeder 1A2, and a large-capacity sheet feed cassette 81.

The main body 1A1 includes an image forming section 14 having an exposure unit 1, developing device 2, toner supplying device 30, photoconductor drum 3, charging device 4, static eliminator 41, transfer section 10 that directly or indirectly transfers the toner image formed onto the photoconductor drum (member to be cleaned) 3 to a sheet P, and a fixing section 6 for fixing the toner image onto the sheet, a sheet transporting device 7, a sheet transporting path 7*a*, a sheet feed tray 8, sheet discharge tray 9, a manual tray 82, a control section, not shown, that integrally controls the overall of the image forming process and post-process, and an operating section, not shown, arranged at the front side of the main body 1A1. The image forming apparatus is configured such that the transporting speed of the sheet P is selectively controlled according to a print command, and the sheet P can be automatically fed from the sheet feed tray 8 to the sheet discharge tray 9, based on the transporting speed of the sheet P corresponding to plural discharging process modes set beforehand.

The main body 1A1 includes waste toner collecting devices having the aforesaid configuration and arranged at corresponding portions of the image forming section 14, the transfer section 10, and the fixing section 6 in the printing process. Specifically, the main body 1A1 includes a first waste toner collecting device (photoconductor drum cleaning apparatus) 150 for removing and collecting the residual toner on the surface of the photoconductor drum 3 as a waste toner, a second waste toner collecting device (transfer belt cleaning apparatus) 250 for removing and collecting the toner adhered onto the surface of the transfer belt 103 of the transfer section 10 as a waste toner, and a third waste toner collecting device (fuser roller cleaning apparatus) 350 for removing and collecting the toner adhered onto the fuser roller in the fixing section 6 as a waste toner. These waste toner collecting devices remove the residual toner, produced at the corresponding sections during the printing process, as a waste toner.

Each section of the image forming apparatus 1A will be explained in detail with reference to FIGS. 4 and 5.

A document placing table 21, which is made of a transparent glass and on which a document is placed, is mounted to the upper surface of the main body 1A1. The automatic document feeder 1A2 is provided above the document placing table 21 so as to be capable of being pivoted and capable of being opened. A scanner section 22 for reading image information of a document is provided below the document placing table 21.

The image forming section 14 is arranged below the scanner section 22, and the sheet feed tray 8 having the sheet P stacked therein is provided below the image forming section 14.

The exposure unit 1 has a function such that it irradiates laser beam to the surface of the photoconductor drum 3, which is uniformly charged by the charging device 4, according to the image data outputted from an image processing section (not shown), so as to expose the surface of the photoconductor drum 3, whereby an electrostatic latent image according to the image data can be written onto the surface of the photoconductor drum 3.

The exposure unit 1 is arranged immediately below the scanner section 22 and above the photoconductor drum 3. Laser scanning units (LSU) 13*a* and 13*b* provided with laser irradiating sections 11 and 11 and a reflection mirror 12 are employed for the exposure unit 1. In the present embodiment, a technique (two-beam technique) in which a multiple number of laser beams are used to alleviate a rush of irradiation timings per one laser device is employed in order to perform a high-speed printing process.

Although the present embodiment employs LSU 13*a* and 13*b* as the exposure unit 1, an EL or LED writing head having light-emitting devices arranged in an array may be used, for example.

The photoconductor drum 3 is generally cylindrical. It is arranged below the exposure unit 1, and is controlled so as to rotate in a predetermined direction (in the direction shown by an arrow A in the figure) by driving means and control means not shown.

As shown in FIG. 5, a sheet peeling claw 31, the first waste toner collecting device 150, the charging device 4 serving as an electric field generating section, the developing device 2, and the static eliminator 41 are arranged in this order along the outer peripheral surface of the photoconductor drum 3 toward the downstream side in the rotating direction of the photoconductor drum with the position after the image transfer defined as a reference.

The sheet peeling claw 31 is arranged so as to be brought in contact with or separated from the outer peripheral surface of the photoconductor drum 3 by a solenoid 33. The sheet peeling claw 31 peels the sheet P, which clings to the surface of the photoconductor drum 3, when the non-fixed toner image on the photoconductor drum 3 is transferred onto the sheet P.

Instead of the solenoid 32, a driving motor may be employed as the driving means of the sheet peeling claw 31, and other driving means may be selected.

The developing device 2 develops the electrostatic latent image formed on the photoconductor drum 3 with black toner to form a toner image which is a visible image. A registration roller 15 is arranged below the developing device 2 at the upstream side in the sheet transporting direction.

The toner supplying device 30 temporarily stores the toner, which is discharged from a toner container 300 filled with toner, into an intermediate hopper section 33, and then, supplies the toner to the developing device 2. The toner supplying device 30 is arranged so as to be adjacent to the developing device 2.

The registration roller 15 is controlled by driving means and control means, not shown, such that the leading end of the sheet P fed from the sheet feed tray 8 is interfaced with the toner image on the photoconductor drum 3, and the sheet P is transported between the photoconductor drum 3 and the transfer belt 103.

The charging device 4 is charging means for uniformly charging the surface of the photoconductor drum 3 to a predetermined potential. It is arranged above the photoconductor drum 3 in the vicinity of the outer periphery. In the present embodiment, a charger-type charging device 4 is used. However, a contact roller type or a brush type may be used instead.

The static eliminator 41 is pre-transfer static eliminating means for lowering the surface potential of the photoconductor drum 3 in order to make it easy to transfer the toner image, formed on the surface of the photoconductor drum 3, onto the sheet P. It is arranged to the vicinity of the lower part of the outer periphery of the photoconductor drum 3. In the present embodiment, the static eliminator 41 is composed by use of a static eliminating electrode. However, a static eliminating lamp may be used instead of the static eliminating electrode, and other methods may be used for static elimination.

The first waste toner collecting device 150 removes and collects toner, paper powders, dusts, etc. remaining on the surface of the photoconductor drum 3 after the development and image transfer. It is arranged at the position generally opposite to the developing device 2 across the photoconductor drum 3, and arranged substantially horizontal at the side of the photoconductor drum 3 (left side in the figure).

As described above, the electrostatic image which is made visible on the photoconductor drum 3 is transferred onto the sheet P by applying the electric field whose polarity is reverse to the polarity of the charges of the electrostatic image from the transfer section 10 to the sheet P that is being transported. For example, when the electrostatic image has charges of (−) polarity, the transfer section 10 has charges of the (+) polarity.

The transfer section 10 is composed of a transfer belt unit in which a transfer belt 103 is looped around the outer peripheries of a drive roller 101, a driven roller 102 and other rollers. The transfer belt 103 has a predetermined resistance value (in the present embodiment, $1\times10^{9}$ to $1\times10^{13}$ Ω·cm). The transfer belt 103 is arranged such that its surface is in contact with a part of the outer periphery of the cylindrical photoconductor drum 3. The transfer belt 103 transports the sheet P, while pressing the sheet P against the photoconductor drum 3.

An elastic conductive roller 105, which can be applied a transfer electric field with conductivity different from that of the drive roller 101 and the driven roller 102, is arranged at the contact portion 104 of the photoconductor drum 3 and the transfer belt 103.

The elastic conductive roller 105 is made of a soft material such as an elastic rubber, foaming resin, etc. The elasticity of the elastic conductive roller 105 allows the photoconductor drum 3 and the transfer belt 103 to be in surface contact with each other having a predetermined width called a transfer nip, not in line contact with each other. Therefore, the transfer efficiency to the sheet P which is being transported can be enhanced.

A static eliminating roller 106, which eliminates the electric field applied to a sheet P that is being transported at the transfer area in order to smoothly transport the sheet P to the next process, is arranged at the backside of the transfer belt 103 at the downstream side of the transfer area of the transfer belt 103 in the sheet transporting direction.

The transfer section 10 includes the second waste toner collecting device 250 for cleaning the stains due to the residual toner on the transfer belt 103, and a plurality of static eliminating mechanisms 108 for eliminating charges on the transfer belt 103. The methods for the static elimination used for the static eliminating mechanisms 108 include the method for grounding through a device or a method of positively applying a polarity reverse to the polarity of the transfer electric field.

The electrostatic image (non-fixed toner) transferred onto the sheet P at the transfer section 10 is transported to the fixing unit 6 where heat and pressure are applied, so that the non-fixed toner is fused and fixed onto the sheet P.

The fixing section 6 includes a heat roller 6*a* and a pressure roller 6*b*, which compose a fuser roller.

The heat roller 6*a* has incorporated therein a heat source 614 for setting the surface of the heat roller to a predetermined temperature (fixing set temperature: about 160 to 200° C.). A sheet peeling claw 611, a thermistor 612 serving as a detecting section of the surface temperature of the roller, and the third waste toner collecting device 350 that cleans the outer peripheral portion of the heat roller 6*a* are arranged around the outer periphery of the heat roller 6*a*.

Pressure members 621 that cause the pressure roller 6*b* to be in pressed contact with the heat roller 6*a* with a predetermined pressure are arranged at both ends of the pressure roller 6*b*. Further, a sheet peeling claw 622 and a roller surface cleaning member 623 are arranged at the outer periphery of the pressure roller 6*b*.

The heat roller 6*a* is rotated to pass the sheet P between the heat roller 6*a* and the pressure roller 6*b* with the sheet P nipped between the heat roller 6*a* and the pressure roller 6*b*, whereby the toner image transferred onto the sheet P can be fused and fixed.

A transport roller 16 for transporting the sheet P is provided at the downstream side of the fixing section 6 in the sheet transporting direction, and a sheet discharge roller 17 for discharging the sheet P onto the sheet discharge tray 9 is provided at the downstream side of the transport roller 16 in the sheet transporting direction.

The sheet feed tray 8 stacks a plurality of sheets on which image information is outputted (printed), and it is arranged below the image forming section 14. A pickup roller 8*a* is arranged above the sheet feed tray 8 at its downstream side in the sheet transporting direction.

The pickup roller 8*a* picks up one by one the sheet P from the uppermost sheet of the sheet stack in the sheet feed tray 8, and transports the same to the transfer section 10 through the sheet transporting path 7*a*.

The image forming apparatus 1A according to the present embodiment has two sheet feed trays 8, which are vertically arranged and can accommodate 500 to 1500 sheets P of a standard size each, below the image forming section 14, in order to achieve a high-speed printing process.

The large-capacity sheet feed cassette 81 can accommodate a great amount of sheets of various types, and is arranged at the side face of the main body 1A.

The manual sheet feed tray 82 is mainly used for performing a printing on a sheet of a non-standard size, and is arranged at the side face above the large-capacity sheet feed cassette 81 at the main body 1A1.

The sheet discharge tray 9 is arranged at the side face of the main body 1A1 opposite to the manual sheet feed tray 82. Instead of the sheet discharge tray 9, a post-processing apparatus that performs a stapling process or punching process to the discharged sheet, a multi-stage discharge tray, etc. may be arranged as an option.

The sheet transporting device 7 is composed of a first sheet transporting path for transporting a sheet to the transfer section 10 from the sheet feed tray 8, a second sheet transporting path for transporting the sheet, having the toner image fixed thereon, from the fixing section 6 to the sheet discharge tray 9, a third sheet transporting path for inversing and transporting the sheet, having the toner image fixed thereon, from the fixing section 6 to the transfer section 10 when two-sided printing is performed, a branch claw that changes the transporting path to the second sheet transporting path or to the third sheet transporting path, and transport rollers arranged on the respective sheet transporting paths with a predetermined space.

In the image forming apparatus 1A, two predetermined sheet discharging processing modes, namely, one-sided printing mode and two-sided printing mode are prepared. The one-sided printing mode includes two sheet discharging modes, i.e., a face-up discharge by which the sheet is discharged with its printed surface facing upward and a face-down discharge by which the sheet is discharged with its printed surface facing downward.

The control section includes a CPU, a ROM that stores a control program executed by the CPU, a RAM that provides a work area to the CPU, a non-volatile memory that holds control data, an input circuit to which signals from the respective detecting means of the image forming apparatus are inputted, a driver circuit that drives actuators or motors for operating the respective driving mechanisms of the image forming apparatus, an output circuit for driving laser irradiating sections 11, 11, etc. The control section also controls the drive of the servo motors of the respective driving sections of the first, second, and the third waste toner collecting devices 150, 250, and 350.

According to the image forming apparatus thus configured, during the image forming process in which the photoconductor drum 3 of the image forming section 14, the transfer belt 103 of the transfer section 10, and the heat roller 6*a* of the fixing section 6 are operated, the control section can control the servo motors of the respective driving sections in such a manner that the transport screws of the first, second and third waste toner collecting devices 150, 250 and 350 are normally rotated (see FIG. 1B).

At the time of completing the image forming process, the control section can control the servo motors of the respective driving sections in such a manner that the servo motors of the respective driving sections of the first, second and third waste toner collecting devices 150, 250 and 350 are stopped, or the transport screws are inversely and normally rotated several times, and then, stopped.

Even in the stand-by state of the image forming apparatus, the control section may control the servo motors of the respective driving sections in such a manner that the transport screws of the first, second and third waste toner collecting devices 150, 250 and 350 are normally and inversely rotated in order to loosen the waste toner in the waste toner transporting path.

What is claimed is:

1. A waste toner collecting device comprising:

a waste toner removing section that removes toner which is adhered on a surface of a member to be cleaned, as a waste toner;

a waste toner storing section that stores the waste toner; and a waste toner transporting section that transports the waste toner to the waste toner storing section, wherein the waste toner transporting section includes:

a waste toner transporting path, a rotatable shaft arranged in the waste toner transporting path, a transport screw that is arranged around an outer periphery of the shaft in the waste toner transporting path, wherein a first end of the transport screw is rotationally coupled to the shaft, and wherein a second end of the transport screw is free to rotate with respect to the shaft, and a driving section that is coupled to the second end of the transport screw so as to transmit a rotational force to the transport screw.

2. The waste toner collecting device according to claim 1, wherein the driving section includes a servo motor that can normally and inversely rotate.

3. The waste toner collecting device according to claim 1, wherein the transport screw is made of a coil spring.

4. The waste toner collecting device according to claim 1, wherein the member to be cleaned is at least one of a photoconductor, a transfer belt that transfers a toner image from a surface of a photoconductor onto a recording sheet, and a fuser roller that fixes a toner image transferred onto a recording sheet.

5. An image forming apparatus comprising:

a photoconductor upon which a toner image is formed;

a sheet feeding section that feeds a recording sheet to the photoconductor;

a transfer section having a transfer belt that transfers the toner image from the photoconductor to the recording sheet;

a fixing section having a fuser roller that fixes the toner image transferred onto the recording sheet; and a waste toner collecting device according to claim 1, wherein the waste toner collecting device collects waste toner from at least one of the photoconductor, the transfer belt, and the fuser roller.

6. The image forming apparatus according to claim 5, further comprising a control section that controls the driving section of the waste toner collecting device such that the transport screw of the waste toner collecting device is normally rotated and inversely rotated.

7. The waste toner collecting device according to claim 1, wherein when the driving section imparts a rotational force to the transport screw that causes the transport screw to rotate in a first direction that moves toner in the transporting path toward the waste toner storing section, the transport screw tends to tighten around the outer periphery of the shaft.

8. The waste toner collecting device according to claim 7, wherein when the driving section imparts a rotational force to the transport screw that causes the transport screw to rotate in a second direction that is opposite to the first direction, the transport screw tends to expand away from the outer periphery of the shaft.

9. The waste toner collecting device according to claim 8, wherein the driving section is configured such that when the driving section stops causing the transport screw to rotate in the first direction, the driving section causes the transport screw to rotate in the second direction for a predetermined period of time.

10. The waste toner collecting device according to claim 8, wherein the driving section is configured such that when driving section stops causing the transport screw to rotate in the first direction, the driving section causes the transport screw to rotate in the second direction for a predetermined amount of rotation.

11. A waste toner collecting device comprising:

a waste toner removing section that removes waste toner from a surface of a member to be cleaned;

a waste toner storing section that stores the waste toner; and a waste toner transporting section that transports the waste toner to the waste toner storing section, wherein the waste toner transporting section includes:

a waste toner transporting path, a rotatable shaft arranged in the waste toner transporting path, a transport screw that is arranged around an outer periphery of the shaft in the waste toner transporting path, wherein a first end of the transport screw is rotationally coupled to a first end of the shaft, and wherein a second end of the transport screw is free to rotate with respect to a second end of the shaft, and a driving section that is coupled to the shaft so as to transmit a rotational force to shaft.

12. The waste toner collecting device according to claim 11, wherein the driving section includes a servo motor that can normally and inversely rotate.

13. The waste toner collecting device according to claim 11, wherein the transport screw is made of a coil spring.

14. The waste toner collecting device according to claim 11, wherein the member to be cleaned is at least one of a photoconductor, a transfer belt that transfers a toner image from a surface of a photoconductor onto a recording sheet, and a fuser roller that fixes a toner image transferred onto a recording sheet.

15. An image forming apparatus comprising:

a photoconductor upon which a toner image is formed;

a sheet feeding section that feeds a recording sheet to the photoconductor;

a transfer section having a transfer belt that transfers a toner image from the photoconductor to the recording sheet;

a fixing section having a fuser roller that fixes a toner image transferred onto the recording sheet; and a waste toner collecting device according to claim 11, wherein the waste toner collecting device collects waste toner from at least one of the photoconductor, the transfer belt, and the fuser roller.

16. The image forming apparatus according to claim 15, further comprising a control section that controls the driving section of the waste toner collecting device such that the transport screw of the waste toner collecting device is normally rotated and inversely rotated.

17. The waste toner collecting device according to claim 11, wherein when the driving section imparts a rotational force to the shaft that causes the shaft and the transport screw to rotate in a first direction that moves toner in the transporting path toward the waste toner storing section, the transport screw tends to tighten around the outer periphery of the shaft.

18. The waste toner collecting device according to claim 17, wherein when the driving section imparts a rotational force to the shaft that causes the shaft and the transport screw to rotate in a second direction that is opposite to the first direction, the transport screw tends to expand away from the outer periphery of the shaft.

19. The waste toner collecting device according to claim 18, wherein the driving section is configured such that when the driving section stops causing the shaft and the transport screw to rotate in the first direction, the driving section causes the shaft and the transport screw to rotate in the second direction for a predetermined period of time.

20. The waste toner collecting device according to claim 18, wherein the driving section is configured such that when driving section stops causing the shaft and the transport screw to rotate in the first direction, the driving section causes the shaft and the transport screw to rotate in the second direction for a predetermined amount of rotation.

* * * * *